US006000664A

United States Patent [19]

Hood

[11] Patent Number: 6,000,664

[45] **Date of Patent: *Dec. 14, 1999**

[54] BABY BOTTLE SUPPORT BIB

[76] Inventor: Maurice Hood, 5320 N. Sheridan Rd., Apt. 1509, Chicago, Ill. 60640

[ * ] Notice: This patent issued on a continued prosecution application filed under 37 CFR 1.53(d), and is subject to the twenty year patent term provisions of 35 U.S.C. 154(a)(2).

[21] Appl. No.: 08/574,872

[22] Filed: Dec. 19, 1995

[51] Int. Cl.[6] ..... A47D 15/00

[52] U.S. Cl. ..... 248/102; 248/104; 248/205.2

[58] Field of Search ..... 248/102, 104, 248/205.2; 224/148.4, 148.5, 148.6, 148.7, 605, 901.8

[56] References Cited

U.S. PATENT DOCUMENTS

| | | | |
|---|---|---|---|
| D. 211,435 | 6/1968 | Kausen et al. | D83/8 |
| 2,893,672 | 6/1959 | Vardan . | |
| 3,065,944 | 11/1962 | Liebendorfer . | |
| 3,144,230 | 8/1964 | Brooks . | |
| 3,197,099 | 7/1965 | Doba . | |
| 3,850,393 | 11/1974 | Marquard . | |
| 3,977,638 | 8/1976 | Woodard . | |
| 4,220,302 | 9/1980 | Hampton et al. . | |
| 4,414,692 | 11/1983 | Dzierson et al. | 224/901.8 X |
| 4,498,613 | 2/1985 | Donahue et al. . | |
| 4,537,341 | 8/1985 | Kelly | 248/104 X |
| 4,564,957 | 1/1986 | Scharf | 2/75 |
| 4,663,779 | 5/1987 | Bible | 2/49 R |
| 4,713,842 | 12/1987 | Patterson | 224/148.6 X |
| 4,719,650 | 1/1988 | Milloy | 2/49 R |
| 4,776,546 | 10/1988 | Goldson et al. . | |
| 5,060,835 | 10/1991 | Payne | 224/224 |
| 5,217,294 | 6/1993 | Liston | 362/105 |
| 5,240,156 | 8/1993 | Sicotte et al. | 224/151 |
| 5,312,252 | 5/1994 | Cooper | 446/27 |
| 5,325,991 | 7/1994 | Williams | 224/901.8 X |
| 5,505,356 | 4/1996 | Noriega et al. | 224/250 |
| 5,509,141 | 4/1996 | Saltzman | 2/49.2 |
| 5,573,153 | 11/1996 | Stillman | 224/148.6 |
| 5,624,090 | 4/1997 | Gammelgaard | 248/102 |

*Primary Examiner*—Derek J. Berger
*Assistant Examiner*—Kimberly Wood
*Attorney, Agent, or Firm*—Eugene F. Friedman

[57] ABSTRACT

A baby bottle support bib intended to be worn by an individual while bottle feeding a baby. A baby bottle is removably attached to the bib so as to be held in the preferred orientation for feeding the baby.

8 Claims, 1 Drawing Sheet

BABY BOTTLE SUPPORT BIB

BACKGROUND OF THE INVENTION

1. Field of the Invention

The present invention generally relates to the field of devices which assist in the feeding and entertainment of babies. In particular, the present invention relates to a bib that will support one or more baby bottles and/or babies' toys, and which is intended to be worn by an individual assisting a baby in feeding from a bottle. With a baby being held in an arm of a person wearing the bib, the bib will support a bottle in a position for feeding a baby. Thus, a person holding a baby for feeding has at least one hand free for performing other tasks.

With few exceptions, all human babies are breast or bottle feed. For the first six to nine months after birth, the baby lacks both the strength and the coordination necessary to hold the bottle in the position necessary for feeding. Further, even if the baby could properly hold the bottle, it should not be left on its own, since it might drink too much or too quickly or ingest too much air, in which case the bottle must be quickly removed from its mouth to avoid choking and to permit burping or coughing. As a result, such infants are usually fed by an older child or an adult.

When bottle feeding a baby, the baby is usually held in one hand and arm, and the bottle in the other hand of the person feeding the baby. Unfortunately, this activity requires the use of both of the feeding person's hands, thus severely limiting the ability of the person to engage in other activities requiring the use of a hand.

2. Description of the Related Art Including Information Disclosed Under 37 CFR 1.97 and 1.98

The desirability of providing a device or mechanism to hold a baby bottle in position for feeding a baby while the baby is held in one arm, so as to provide the person feeding the baby with at least one free hand, has been previously recognized. A number of devices are known which are mounted on or in the proximity of the infant for the purpose of supporting a bottle for feeding. Other supports, to be worn by an individual feeding a baby, allow closer supervision of the feeding and can simulate the feelings of intimacy and bonding that come with breast feeding a baby. However, these later supports have not provided ready re-adjustment of the bottle position, to accomodate re-positioning of the baby in the holders arm, or when different individuals use the same support for feeding a baby.

The following patents disclose devices which are worn or mounted on an individual and which support a baby bottle for feeding a baby:

| U.S. Pat. No. | Inventor(s) |
|---|---|
| 2,893,672 | Vardan |
| 3,065,944 | Liebendorfer |
| 3,144,230 | Brooks |
| 3,197,099 | Doba |
| 3,850,393 | Marquard |
| 3,977,638 | Woodard |
| 4,220,302 | Hampton et al. |
| 4,498,613 | Donahue et al. |
| 4,776,546 | Goldson et al. |

The Vardan patent reveals a support structure having an arcuate strap which rests on the wearer's shoulder and from which extends a front strap of adjustable length, the end of which is adapted to hold a baby bottle. The Liebendorfer and Brooks patents disclose supports or holders consisting of a strap that encircles the wearer's neck, with one of the strap ends attached to the baby bottle near its top, and the other strap end attached to the baby bottle near its bottom.

The Doba patent sets forth a nursing bottle holder which consists of a loop that encircles the wearer's neck and a free end in the form of a spiral coil which wraps around the baby bottle to hold it. The Marquard patent reveals a baby bottle holder in the form of a U-shaped clamp that is pivotally mounted on a base member, the back surface of which is provide with one portion of a hook and loop type fastening material such as Velcro®. The base member is supported by a strap encircling the wearer's neck, the ends of which strap are provided with the other portion of a hook and loop type fastening material to engage the fastening material on the back of the base member.

The Woodard patent depicts a halter type nursing bottle support consisting of a strap that encircles the wearer's neck, the size of which is adjustable by using a series of snaps, and the free end of which is provided with an elastic loop that wraps around a baby bottle to support it. The Hampton patent shows a nursing bottle holder consistings of a bandolier type strap that obliquely encircles the wearer's torso from a shoulder to the waist on the opposite side. A flange portion, having either the hook or loop portion of a Velcro® type fastener, is provided on the strap to engage a complementary portion of Velcro® type fastener provided on the outer surface of a strap which encircles the bottle and is held in the encircling position by mating hook and loop pads.

The Donahue patent sets forth a support device for nursing bottles and amusement items consisting of a body strap which encircles the wearer's torso either over one shoulder and under the other arm or under both arms. To this body strap is attached a flexible band, the end of which features a frustoconically contoured elastic loop that is adapted to engage the neck portion of a baby bottle or similarly-shaped item. The Goldson patent reveals a bib-like structure with mammary-shaped areas defining pouches for retaining baby bottles. So as to allow feeding, the nipple of the baby bottle protrudes from an opening in the mammary-pouch portion of the bib.

SUMMARY OF THE PRESENT INVENTION

It is an object of the present invention to provide a structure for readily supporting a baby bottle in a position most comfortable and appropriate for feeding a baby held in a users arm, while leaving at least one of the user's hands free to perform other tasks. It is a further object of this invention to provide a structure, in the form of a bib, that permits quick and easy adjustment of the bottle's position such that the position of the baby in the users arm may be readily changed for the comfort of the baby or the user or both. It is a further object of this invention to provide a structure which allows a high degree of freedom of movement of the nipple end of the bottle while the baby is feeding.

It is another object of the present invention to provide a baby bottle support which allows the individual feeding a baby or infant to closely observe and control the feeding of the infant while obviating the need for the individual to hold the baby bottle.

It is another object of the present invention to provide a baby bottle support which also protects the wearer's clothes while bottle feeding a baby.

It is another object of the present invention to provide a baby bottle support which enables an individual to use a baby bottle for feeding a baby while still experiencing the feelings of closeness and bonding with the infant, with the infant held in the general position associated with breast feeding.

It is yet another object of the present invention to provide a baby bottle support which will enable an individual to hold two babies in his or her arms while using separate baby bottles held by the baby bottle support to feed them.

It is a still further object of the present invention to provide a baby bottle support which will enable an individual to keep one or more baby bottles and/or babies' toys in convenient proximity.

In accordance with this invention a baby bottle support structure is provided, a first component of which, preferably in the form of a bib, is worn by an adult individual intending to bottle feed a baby. The first component has a size to at least substantially cover the chest of the individual. It is adapted to support a baby bottle for feeding a baby which is held in an arm of that individual in the most appropriate and comfortable position for feeding the baby. A major portion of the first component includes a first complementary surface of a securing system and is of a size to substantially extend across the width of the individual's chest. The first component of the support structure is preferably shaped like a bib and is worn by the individual feeding the baby.

A second component of the support structure has a fastening system with first and second complementary engaging surfaces for fastening the bottle to the second component. The second component also includes a second complementary securing surface of the securing system coupled to the fastening system. The second complementary securing surface of the second component removably secures at any location on the first complementary securing surface so as to support the bottle in any desirable location across the chest of the individual for the baby to feed while being held in one of the individual's arms in any comfortable position. Thus, the second component is secured to both the bottle and the first component, or bib. One form of complementary securing means are hook and loop materials, one of which is known as VELCRO®. Each second component is capable of holding a baby bottle, baby toy, or other similarly-sized item, and of being secured to the first portion.

DETAILED DESCRIPTION OF THE PREFERRED EMBODIMENT

Figure 1:
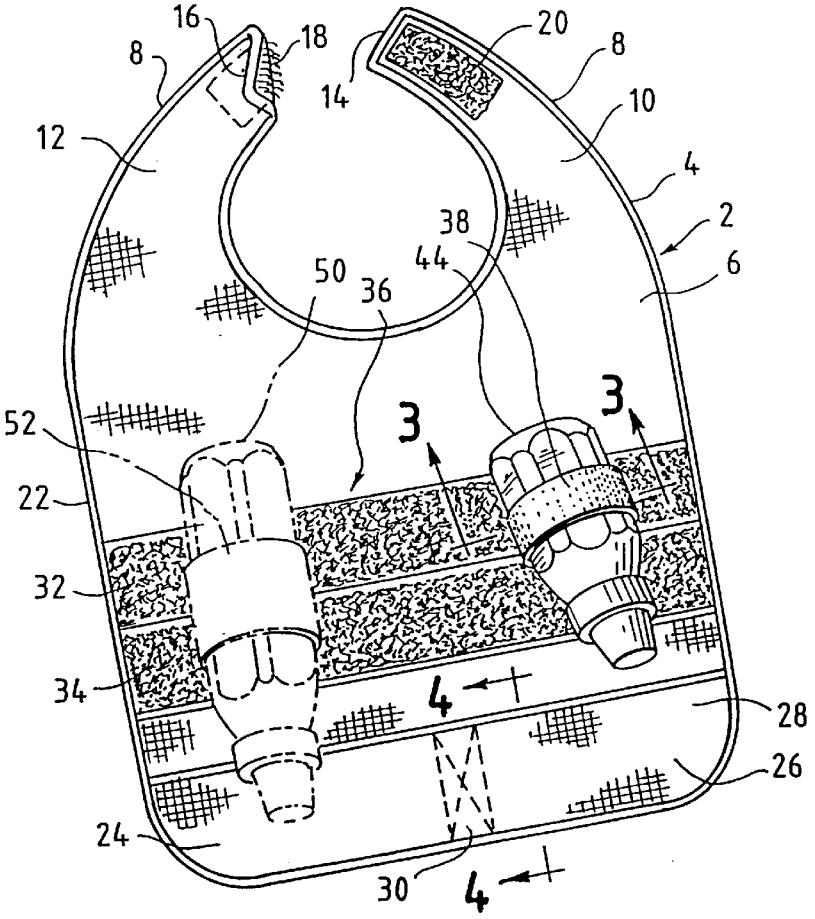
FIG. 1 is a front elevational view of a baby bottle support structure in the form of a bib with two baby bottles attached, in accordance with a preferred embodiment of the present invention.
Figure 2:
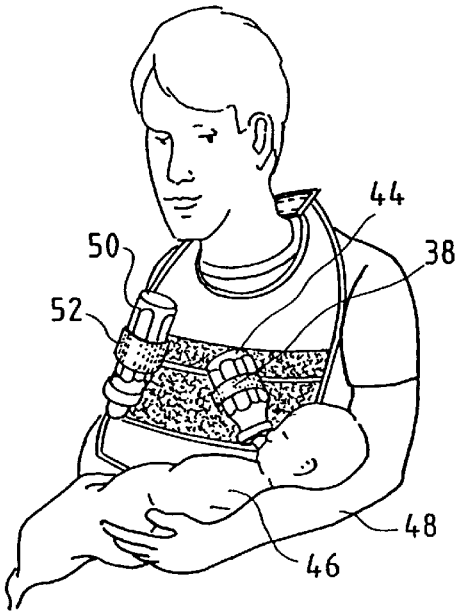
FIG. 2 is a perspective view showing the manner in which the bib may be worn by an adult and bottles attached thereto to feed a baby.

Referring first to FIG. 1, a baby bottle support structure in accordance with the preferred embodiment of this invention will be described. The baby bottle support structure 2, includes a first portion in the form of a bib 4. The bib has a front portion 6 which covers a users chest, and a yoke portion 8 for securing the bib about the neck of the person who will be feeding the baby. In the preferred embodiment, the front portion 6 of the bib substantially covers an adult wearer's chest, as shown in FIG. 2. The yoke portion 8 is made of two strips of material, 10 and 12, which may be formed integral with the front bib portion 4 or sewed thereto. The strips of material 10 and 12 are of such dimensions as to pass around the user's neck, as shown in FIG. 2, and to overlap each other at their ends 14 and 16. As shown in FIG. 1, the ends 14 and 16 of the yoke may be fastened to each other behind the wearer's neck by means of complementary hook and loop pads 18 and 20.

The bib 4 may be made of any suitable fabric, which is flexible, can be folded or rolled up, is absorbent, and which may be laundered, such as cotton,. A reinforcing and protective edging 22 is provided around the entire perimeter of the bib 4. The edging is made of suitable strip of fabric which surrounds the front and back sides of the edge of bib 4 and is sewn thereto.

Figure 4:
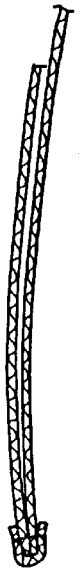
FIG. 4 is a cross-sectional view taken on line 4—4 in FIG. 1.

A pair of pockets 24 and 26, which may be used to carry small toys, or napkins, are attached to the front of the bib overlying its lower portion as shown in FIG. 1. Referring to FIGS. 1 and 4, the pockets 24 and 26 are preferably formed by attaching to the lower edge of the front of the bib 4 a strip of fabric 28, having substantially the same shape as the lower portion of the bib 4. The strip of fabric 28 may be made of the same material as is the bib 4. The edges of the strip of fabric 28 are sewn to the corresponding edges of the bib 4, with the edging 22 surrounding both layers of fabric, as shown in FIGS. 2 and 4. As shown in FIG. 1, the center of the strip of fabric 28 is also stitched to the front bib portion 2 at the center 30 of the width of the bib to form the separate left and right pockets 24 and 26.

One or more strips 32 and 34 of a complementary type fastening material, such as hook and loop material are sewn to the front of the bib above the pockets 24 and 26 to form an attachment or securing area 36. In the preferred embodiment of this invention, the securing area 36, and therefor the bib 4 are made as wide and as long as necessary to substantially cover the entire chest area of the person wearing the bib.

Figure 3:
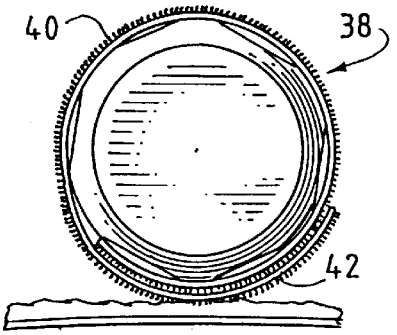
FIG. 3 is a cross-sectional view taken on line 3—3 in FIG. 1.

As shown in the FIGS. 1 and 2, baby bottles may be removable attached or secured to the attachment or securing area 36 by means of a second portion of the support structure, which in the preferred embodiment is in the form of mounting straps or loops 38. Referring to FIG. 3, a mounting strap or loop 38, is formed of an elongated strip 40 of a fastening material, which is complementary to that of which strips 32 and 34 are formed. For instance, if the fastening material is of the hook and loop type, and if the strips 32 and 34 are formed of the loop type fastening material, then the elongated strip 40 would be formed of the hook type fastening material. A pad 42 of the loop type fastening material is secured on the non-fastening side of the elongated strip 40 as is shown in FIG. 3. The pad 42 is located adjacent to one end of the elongated strip 40. A mounting loop 38 is secured to a bottle 44 or similar item by wrapping the elongated strip 40 snugly around the bottle, beginning with the end opposite that on which the pad 42 is secured, with the fastening side of elongated strip 40 facing outward. The mounting loop 38 is held snugly around a bottle 44 by pressing the pad 42 against the fastening side of elongated strip 40.

Referring to FIG. 2, with a baby 46 comfortable held in arm 48, the other arm may be used to properly position the nipple of the bottle 44 in the baby's mouth, and then press the bottle and elongated strip 40 against the securing area 36 to fastened the strip 40 to the securing area 36 and thereby support the bottle 44 on the bib 4.

In this way, a person may wear the bib 4 with a baby bottle 44 attached in the proper orientation so as to stay in the baby's mouth for feeding, as shown in FIG. 2. With the bottle fixed in the proper position on the bib, the person feeding the baby needs use only one hand to hold the baby, such that the other hand is free to perform other tasks. Alternatively, if the user is seated such that the baby is comfortably and safely supported on his or her lap, then both of the person's hands are free to perform other tasks, such as holding a telephone in one hand and writing with the other hand.

A second larger bottle 50 is shown supported on the bib 4 by a second elongated strip 52. So as to provide additional support for the larger bottle 50, the second elongated strip 52 is made wider than the first elongated strip 40. While the infants to be fed are yet quite small, two babies could be fed at the same time, with a bottle for each being supported by the bib 4.

With one elongated strip 40 used to support a bottle 44 for feeding an infant, another strip such as 52 could be used to support a toy on the bib 4 in a position such that the babies hands could reach it while feeding.

While the preferred embodiment of the present invention has been shown, it should be apparent to those skilled in the art that what has been described is considered at present to be the preferred embodiment of the baby bottle support bib of this invention. In accordance with the patent statutes, changes may be made in the baby bottle support bib without actually departing from the true spirit and scope of this invention. The appended claims are intended to cover all such changes and modifications which fall in the true spirit and scope of this invention.

I claim:

1. A support bib for assisting an adult individual in feeding a baby from a baby bottle comprising:

(A) a first bib component having a yoke member for encircling the adult individual's neck and adapted to be of a size to at least substantially cover the chest of the adult individual, said yoke member being formed of fabric connecting to the remainder of said first bib component, a major portion of the first component including an elongated first complementary securing hook or loop surface of a securing system substantially extending across a width of first bib component; and (B) a second bib component including:

(1) an adhering system having first and second complementary attaching surfaces for adhering said second bib component to the baby bottle, said second bib component being a flexible strip of generally elongated rectangular shape having first and second sides; and (2) a second complementary hook or loop securing surface of said securing system coupled to said flexible strip, said second complementary securing surface being removably securable at any location on said first complementary securing surface so as to support the baby bottle in any desirable position across the chest of said individual for any comfortable position whereby a baby bottle may be positioned at substantially any location along said first complementary securing surface, said second complementary securing surface and said second complementary attaching surface being provided on said first side of said strip, and an end portion of said second side of said strip being provided with said first complementary securing surface, whereby said strip may be wrapped snugly around the baby bottle and a portion of said first complementary attaching surface engaged with said second complementary attaching surface on said first side of said strip to secure said strip about the baby bottle, and a portion of said second complementary securing surface engaged with said first complementary securing surface on said first component to support the baby bottle on said first bib component.

2. The support bib of claim 1, wherein said first complementary securing surface extends horizontally entirely across said first component.

3. The bib of claim 1 wherein said yoke member is formed of two strips having free ends which are provided with fastening means for fastening said ends together.

4. The support bib of claim 3 wherein said first bib component is formed of a fabric and said first complementary securing surface is fastened to said fabric.

5. The support bib of claim 3 wherein at least one pocket is provided on said first component in an area below said first complementary securing surface.

6. The support bib of claim 1 wherein said second complementary securing surface and said second complementary attaching surface form a substantially continuous web of hooks or loops substantially covering said first side of said second bib component, said web being removably securable to said first complementary securing surface and said first complementary attaching surface.

7. A support bib for assisting an adult individual in feeding a baby from a baby bottle comprising:

(A) a first bib component having a yoke member for encircling the adult individual's neck and adapted to be of a size to at least substantially cover the chest of the individual, said yoke member being formed of two strips having ends which are provided with complementary hook and loop fastening means, a major portion of the first component including an elongated first complementary securing hook or loop surface of a securing system substantially extending across a width of first bib component, said first bib component having at least one pocket provided at a lower edge thereof; and (B) a second bib component including:

(1) an adhering system having first and second complementary attaching surfaces for adhering said second bib component to the baby bottle, said second bib component being a flexible strip of generally elongated rectangular shape having first and second sides; and (2) a second complementary hook or loop securing surface of said securing system coupled to said flexible strip, said second complementary securing surface being removably securable at any location on said first complementary securing surface so as to support the baby bottle in any desirable position across the chest of said individual for any comfortable position whereby a baby bottle may be positioned at substantially any location along said first complementary securing surface, said second complementary securing surface and said second complementary attaching surface substantially covering said first side of said strip, and an end portion of said second side of said strip being provided with said first complementary attaching surface, whereby said strip may be wrapped snugly around the baby bottle and a portion of said first complementary attaching surface engaged with said second complementary attaching surface on said first side of said strip to secure said strip about the baby bottle, and a portion of said second complementary securing surface engaged with said first complementary securing surface on said first component to support the baby bottle on said first bib component.

8. The support bib of claim 7 wherein said second complementary securing surface and said second complementary attaching surface form, on said first side of said second bib component, a substantially continuous web of hooks or loops removably securable to said first complementary securing surface and said first complementary attaching surface.

* * * * *